United States Patent [19]

Hertzler

[11] Patent Number: 4,478,172

[45] Date of Patent: Oct. 23, 1984

[54] CHANGEABLE LIQUID RESERVOIR AND STIRRER APPARATUS

[75] Inventor: Merle E. Hertzler, Berks County, Pa.

[73] Assignee: RCA Corporation, New York, N.Y.

[21] Appl. No.: 560,390

[22] Filed: Dec. 12, 1983

[51] Int. Cl.[3] ..... B05C 1/02

[52] U.S. Cl. ..... 118/612; 118/243; 118/262

[58] Field of Search ..... 118/243, 612, 262, 256, 118/200, 254

[56] References Cited

U.S. PATENT DOCUMENTS 2,787,243 4/1957 Essmann ..... 118/256

4,351,265 2/1981 Hertzler ..... 118/211

*Primary Examiner*—John P. McIntosh

*Attorney, Agent, or Firm*—Eugene M. Whitacre; Dennis H. Irlbeck; Lester L. Hallacher

[57] ABSTRACT

A changeable liquid reservoir apparatus has a hollow rotating drum, the shaft of which includes an identical coupling on both ends. Both ends of the reservoir include slots which are equidistant from the shaft. Permanently positioned retainer members engage the slots. The shaft of a motor has a coupling which engages the drum coupling. The reservoir, therefore, can be retained in either of two directions and is changeable without the need for tools.

3 Claims, 4 Drawing Figures

CHANGEABLE LIQUID RESERVOIR AND STIRRER APPARATUS

BACKGROUND OF THE INVENTION

This invention relates generally to a liquid reservoir apparatus and particularly to an easily changeable liquid reservoir for providing the liquid to the applicator of a device for applying a conductive coating to the studs of a kinescope faceplate panel.

U.S. Pat. No. 4,351,265 describes a system for applying a conductive liquid to the studs of a color kinescope faceplate panel. The system receives a kinescope faceplate panel in a centered position with the panel facing downwardly. A plurality of conductive liquid reservoirs are arranged to move simultaneously in opposite directions beneath the panel to bring the paint reservoirs into the proximity of the studs which are embedded in the sides of the faceplate panel at known locations. Arranged in the liquid reservoirs are small drums which rotate through the liquid. Applicators are positioned near the drums and are brought into contact with the outside surface of the drums to apply conductive liquid to the applicators. Each of the applicators is brought into contact with one of the studs of the faceplate panel to apply the conductive liquid to the studs.

The device described in the aforesaid patent functions quite satisfactorily for the purposes intended. However, it has been found that the reservoir, drum and applicators need frequent cleaning and the conductive liquid is more uniform if it is constantly stirred, or agitated. The instant invention is directed to a reservoir in which the liquid is constantly stirred, which is readily removed and inserted without the use of tools, and which can be inserted from either of two orientations.

SUMMARY

A changeable liquid reservoir and stirrer apparatus includes a hollow rotatable drum having a plurality of baffles arranged on the inside surface. Both ends of the drum shaft include a coupling for engaging a mating coupling on a shaft which rotates the drum shaft. A base member supports the reservoir and includes a plurality of guide slots symmetrically disposed with respect to both ends of the drum shaft. A plurality of holding members is arranged to receive the guide slots whereby the base member is receivable by the holding members in either of two directions. The base is biased to also bias the couplings into engagement.

DETAILED DESCRIPTION

Figure 1:
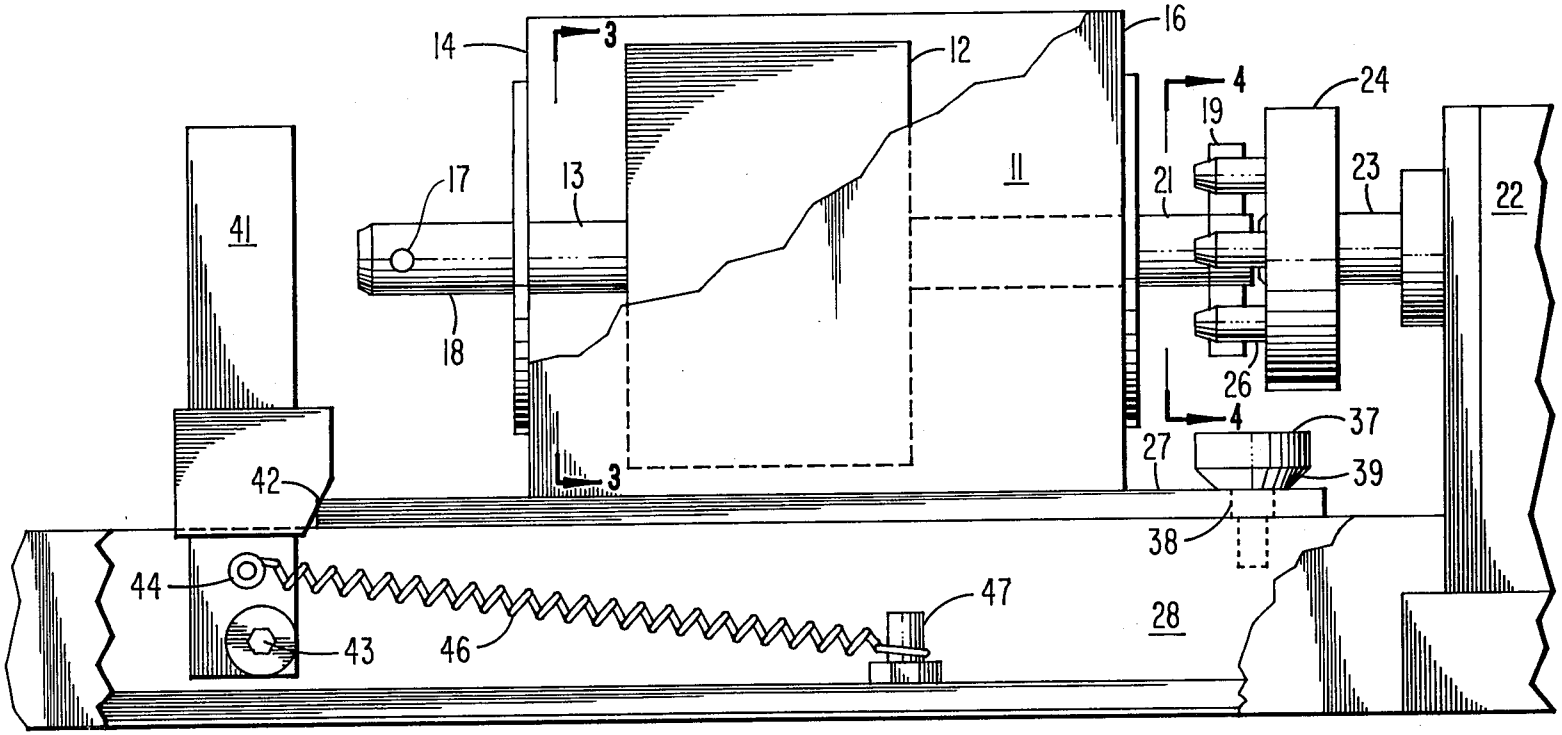
FIG. 1 is a side view, partially broken away, of a preferred embodiment.
Figure 2:
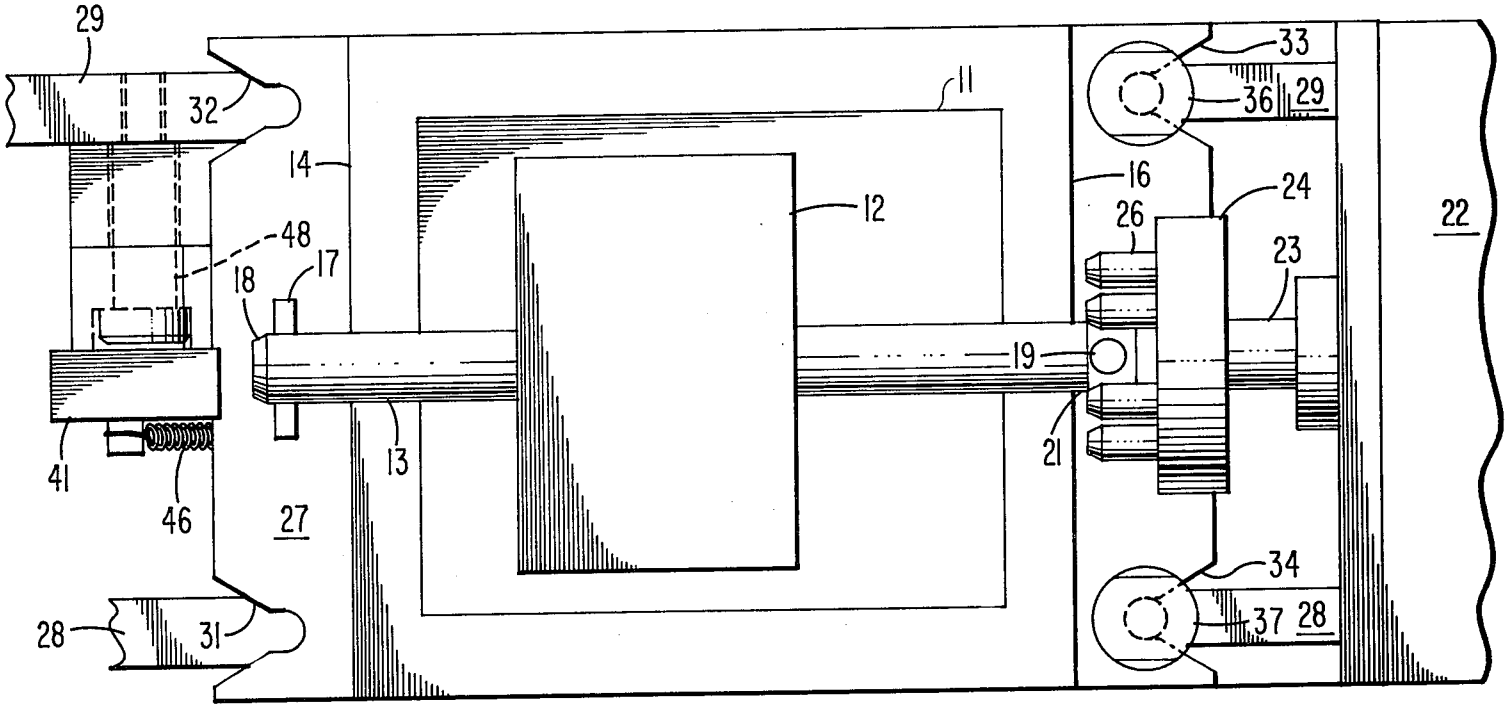
FIG. 2 is a top view of the preferred embodiment of FIG. 1.

In FIGS. 1 and 2 a reservoir 11, partially broken away in FIG. 1, rotatably supports a shaft 13. A hollow drum 12 is permanently fixed to the shaft 13. The shaft 13 rotatably extends through both sides 14 and 16 of the reservoir 11 and is inhibited from sliding in the reservoir 11 by any convenient means, such as stop portions on the shaft. A pin 17 passes through one end 18 of the shaft 13. Similarly a pin 19 passes through the other end 21 of the shaft 13. The pins 17 and 19 are substantially perpendicular to the longitudinal axis of the shaft 13 and are substantially equal distant from the respective sides 14 and 16 of the reservoir 11. Because the shaft 13 can not slide in the reservoir, the spacings between the pins 17 and 19 from the sides of the reservoir are fixed.

Figure 4:
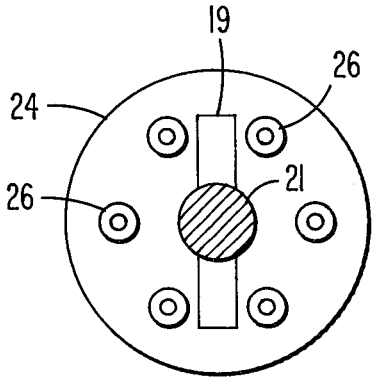
FIG. 4 is an end view of the shaft couplings.

A motor 22 includes a shaft 23 to which is attached a disc 24. The disc 24 includes a plurality of pegs 26 which extend substantially parallel to the longitudinal axis of the shaft 13. The motor 22 is positioned such that the longitudinal axes of the shafts 13 and 23 are aligned. As shown in FIG. 4, the pegs 26 are arranged about the center of the disc 24 and are equal angularly spaced at intervals such that the spacing between adjacent pegs exceeds the diameter of the pin 19 so that the pin can be placed between any two adjacent pins. The pin 17 on the end 18 of the shaft 13 is substantially identical to the pin 19 and thus can be placed between adjacent pegs 26.

The reservoir 11 is permanently affixed to a base member 27 which rests on two substantially parallel rails 28 and 29. As shown in FIG. 2, the base member 27 includes four divergent slots 31, 32, 33 and 34. The centers of the slots 31 to 34 are equidistant from the longitudinal axis of the shaft 13. Additionally, the spacing between the side 16 of the reservoir 11 and the slots 33 and 34 is equal to the spacing between the side 14 and the slots 31 and 32. Also, the pins 17 and 19 are equally spaced from the respective sides 14 and 16. Retainer members 36 and 37 are arranged in the rails 29 and 28, respectively, and are spaced equal to the spacing between the slots 33 and 34. The retainer members 36 and 37 are threaded, or otherwise set, into the rails 28 and 29 to permanently retain the positions of the members with respect to the rails. As shown in FIG. 1, the retainer 37 includes a step portion 38 which is substantially equal to the thickness of the base member 27. The retainer 37 also includes a beveled portion 39. Retainer 36 is configured and dimensioned identically to retainer 37. The base member 27 can be accurately positioned on the rails 28 and 29 by sliding the slots 33 and 34 (or 31 and 32) into engagement with the retainers 36 and 37. The divergent configuration of the slots 33 and 34 causes the semicircular portions of the slots to line up with the stepped portion 38 of the retainers. The beveled portion 39 of the retainers allow the base member 27 to easily slide onto the retainers. Accordingly, the entire apparatus can be placed onto and removed from the support rails 28 and 29 without loosening or tightening the retainer members 36 and 37 so that no tools are required.

A lever arm 41 having a sloped portion 42 is positioned so that the sloped portion rests against an end of the base member 27. The lever 41 is arranged to pivot about an off-center pivot axis 43 and includes a pin 44 which is engaged by a coil spring 46. The other end of the spring 46 is grounded through a pin 47. The center of the pin 44 is displaced from the pivot axis 43 and the pivot axis is displaced from the center line of the lever arm 41. Accordingly, when the lever arm is rotated downwardly away from the base member 27, the lever arm stays in the downward position. When the lever arm is rotated into engagement with the base member 27, the coil spring 46 biases the sloped portion 42 against the base member 27 to bias the slots 33 and 34 (or 31 and 32) into engagement with the retainers 36 and 37. As shown in FIG. 2, the lever arm 41 is supported on the rail 29 by an offset pin 48 so that the lever arm 41 acts near the center of the base member 47 to help assure that slots are biased against the retainers 36 and 37 with substantially equal force and to prevent the base member from tending to tilt with respect to the rails 28 and 29.

Figure 3:
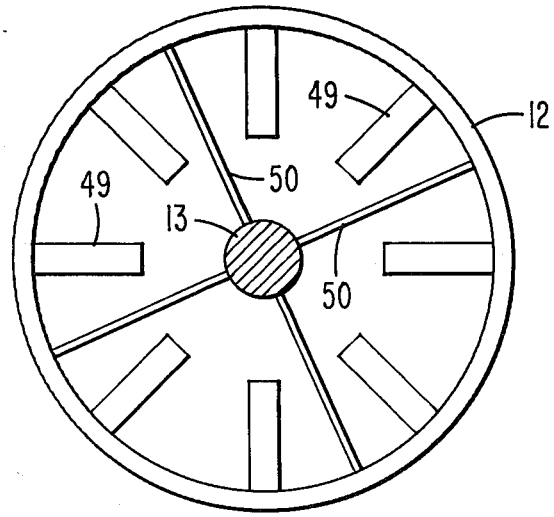
FIG. 3 is an end view of the drum and liquid stirrers.

In FIG. 3, the hollow drum 12 has a plurality of baffles 49 permanently fixed to the inside surface. The baffles 49 are equally spaced about the internal periphery of the drum 12. The drum 12 is affixed to the shaft 13 by any convenient means, such as rods 50.

The slots 31 and 32 have the same symmetry with respect to the shaft 13 as the slots 33 and 34 in the opposite end of the base member 27. Additionally, the distance of the pin 17 from the centers of the slots 31 and 32 is the same as the distance of the pin 19 from the slots 33 and 34. Accordingly, the unit is bilateral and can be accurately positioned on the rails 28 and 29 with either the side 14 or the side 16 facing the motor 22. The pins 17 and 19 freely fit between the pegs 26 and, therefore, the biasing action of the spring 46 causes the slots 33 and 34 to fully engage the retainers 36 and 37 when sliding the slots into engagement with the retainers. It is possible for the pin 17 to initially contact the pegs 26. This poses no problem because a slight rotation of the shaft usually automatically occurs because the ends of the pegs 26 are tapered. Also, the shaft 13 can be manually turned if necessary. After the slots and retainers are engaged, the lever arm 41 is rotated upwardly to retain the unit in the desired position.

The reservoir 11 is filled with sufficient liquid for the lowest part of the drum 12 to be submerged. As the drum rotates, the baffles 49 are pulled through the liquid and the liquid is continuously stirred.

What is claimed is:

1. A changeable liquid reservoir and stirrer apparatus for providing liquid to a liquid applicator comprising:

a reservoir for holding a supply of liquid;

a hollow drum rotatably supported in said reservoir, including a plurality of liquid stirring baffles arranged on the inside surface of said drum, said drum including a shaft having a first coupling member in the proximity of each end;

means for rotating said shaft, said means for rotating including a second coupling member for engaging one of said first coupling members whereby said shaft is selectively engageable from either end;

a base member for supporting said reservoir in the proximity of said liquid applicator, said base member including a plurality of guide means symmetrically disposed with respect to both ends of the shaft;

a plurality of holding members arranged to receive said guide means whereby said base member is receivable by said holding members in either of two directions; and biasing means for biasing one of said first coupling members into engagement with said second coupling member whereby said drum is rotatable in said liquid and said baffles stir said liquid.

2. The apparatus of claim 1 wherein said first coupling members are pins extending through said shaft and said second coupling member includes a disc member having a plurality of pegs extending substantially parallel to said shaft, said pegs being arranged equally about the center of said disc and spaced at intervals whereby said pin rests between at least two of said pegs when said couplings are engaged.

3. The apparatus of claim 2 wherein said biasing means includes a spring biased lever arm arranged to act against the end of said reservoir remote from said means for rotating.

* * * * *